US005129533A

United States Patent [19]

Loffler

[11] Patent Number: 5,129,533

[45] Date of Patent: Jul. 14, 1992

[54] SEAL FOR A CONTAINER CLOSURE

[75] Inventor: Manfred Loffler, Tellig, Fed. Rep. of Germany

[73] Assignee: Alcoa Deutschland GmbH, Worms, Fed. Rep. of Germany

[21] Appl. No.: 785,239

[22] Filed: Nov. 1, 1991

Related U.S. Application Data

[63] Continuation of Ser. No. 590,036, Sep. 28, 1990, abandoned, which is a continuation of Ser. No. 398,664, Aug. 25, 1989, abandoned.

[30] Foreign Application Priority Data

Mar. 25, 1989 [DE] Fed. Rep. of Germany ..... 3909864

[51] Int. Cl.[5] ..... B65D 53/00

[52] U.S. Cl. ..... 215/344; 215/341; 215/270; 215/343

[58] Field of Search ..... 215/270, 344, 341, DIG. 1

[56] References Cited

U.S. PATENT DOCUMENTS

| | | | |
|---|---|---|---|
| Re. 28,521 | 8/1975 | Hammes | 215/317 X |
| 4,209,102 | 6/1980 | Dunn et al. | 215/344 X |
| 4,276,989 | 7/1981 | Hicks | 215/344 X |
| 4,322,011 | 3/1982 | Mumford | 215/270 |
| 4,564,112 | 1/1986 | Breuer | 215/252 X |
| 4,588,100 | 5/1986 | Hsubo et al. | 215/252 |
| 4,741,447 | 5/1988 | John | 215/344 X |

FOREIGN PATENT DOCUMENTS

| | | | |
|---|---|---|---|
| 1322638 | 2/1963 | France | 215/317 |
| 1539307 | 9/1968 | France | 215/341 |
| 579589 | 5/1958 | Italy | 215/341 |
| 564461 | 7/1975 | Switzerland | 215/344 |
| 607702 | 10/1978 | Switzerland | 215/341 |

*Primary Examiner*—Stephen Marcus
*Assistant Examiner*—Paul A. Schwarz
*Attorney, Agent, or Firm*—Staas & Halsey

[57] ABSTRACT

The present invention is a seal for a container closure which is characterized by the fact that associated with the sealing lip (3) is an actuating arm (5) by which the sealing lip can be swiveled. The seal is part of a container closure (1) with a side wall (11) and a bottom (15). When the closure is screwed onto a container, the actuating arm is swiveled counterclockwise, this swivelling movement being facilitated by a deliberate attenuation (17) in the region of the bottom (15) of the closure (1). A counterclockwise swiveling movement of the actuating arm (5) also causes the sealing lip (3) to swivel counterclockwise and thus to lie against the outer wall of the container. A sealing surface is created not only between the container and the actuating arm (5), but also between the outside of the container and the sealing lip (3).

8 Claims, 6 Drawing Sheets

SEAL FOR A CONTAINER CLOSURE

This is a continuation of copending application Ser. No. 07/590,036 filed on Sep. 28, 1990, now abandoned, which is a continuation of Ser. No. 07/398,664, filed Aug. 25, 1989, now abandoned.

BACKGROUND OF THE INVENTION

The invention concerns a seal for a container closure.

SUMMARY OF THE INVENTION

A variety of container closures, especially plastic or metal screw-on, twist-off and bayonet closures, are known. The closures have a paper, plastic or rubber seal designed to provide a secure seal for the container. It has been found, however, that a tight seal is not always reliably obtained, especially when there is an overpressure inside the container to be closed. This is especially true when the container to be closed is damaged in the region of contact of the seal.

It is, therefore, an aim of the invention to create a seal for a container closure which guarantees a strong sealing effect even when there is an overpressure in the container and when there is damage in the region of the mouth of the container.

This aim is achieved in a seal having an actuating arm which swivels the sealing lip to insure that the sealing lip lies snugly against the container to be closed, thereby guaranteeing an optimal sealing effect.

In a preferred embodiment, the actuating arm itself is constructed as a sealing lip. The force exerted on the actuating arm, which causes the associated sealing lip to swivel, also thereby seals the container in the region of the actuating arm. Optimal sealing of the container is achieved by means of the mechanical connection between the sealing lip and the actuating arm also constructed as a sealing lip.

An additional embodiment is characterized by the fact that the actuating arm is part of the container closure. The actuating arm preferably converges with the bottom of the container closure. This type of seal is of especially simple construction and can be manufactured economically in large quantities, especially if the closure is a single part and is made of plastic.

Also preferred is an embodiment in which the actuating arm also converges with the bottom of the container closure, which is, however, characterized by the fact that an attenuated area which facilitates the swiveling movement of the sealing lip is provided in the wall of the container closure in the region of the seal. This causes the sealing lip to lie especially tightly against the container to be closed and seals it in an optimal manner.

Additional configurations and advantages will be apparent from the following detailed description and claims.

DETAILED DESCRIPTION OF THE PREFERRED EMBODIMENTS

Figure 1:
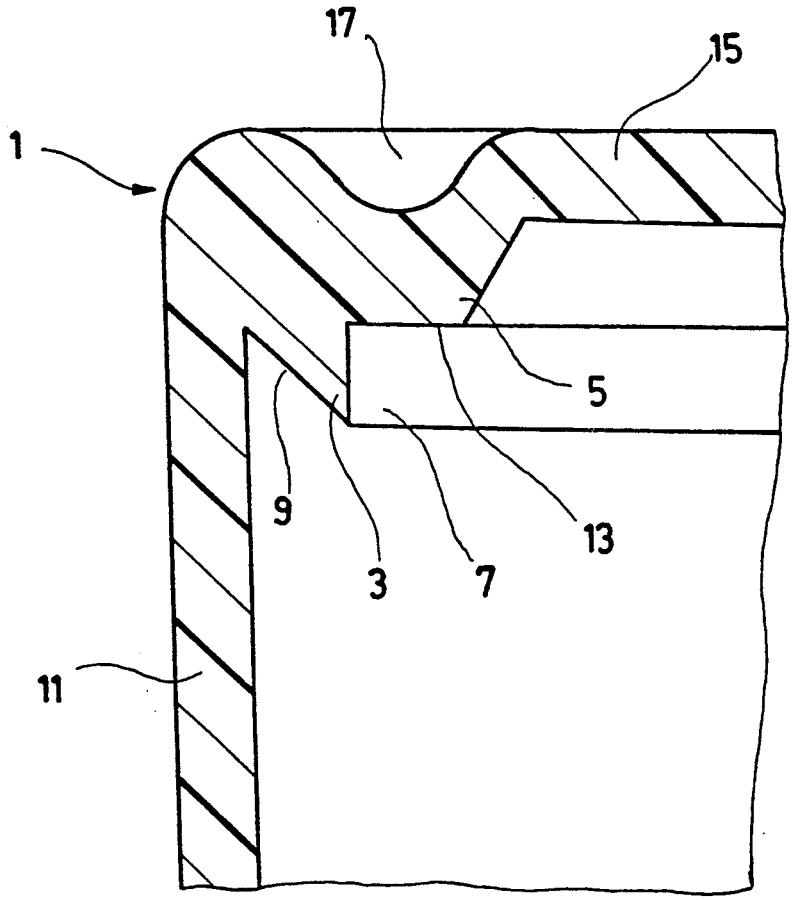
FIG. 1 is a cross section of an initial exemplary embodiment of a seal.

FIG. 1 shows a partial cross section through a plastic closure 1 for containers. The closure is manufactured by plastic injection molding, for example, so that the seal and the closure consist of a single part.

The seal includes a sealing lip 3 and an actuating arm 5. The sealing lip has an essentially triangular cross section, by which a contact surface 7 is formed concentric to the center axis of the container closure.

The outer boundary wall 9 of the sealing lip 3 can form an angle with the contact surface 7 of approximately 15° to 85°, preferably 30° to 60°. In the exemplary embodiment illustrated here in an angle of 45° has been selected.

The outer boundary surface 9 merges with the side wall 11 of the container closure 1.

The actuating arm 5 has a sealing surface oriented forms downwardly in the direction of the container to be closed and forming an angle of approximately 90° with the contact surface 7 of the sealing lip 3. The angle can also be smaller, if the sealing lip or the contact surface 7 is not disposed parallel to the center axis of the container closure 1, but instead is swiveled inwardly.

The side wall 11 of the container closure 1 joins a bottom 15.

In the exemplary embodiment illustrated here, provided in the region of the seal formed by the sealing lip 3 and the actuating arm 5 is an attenuated area 17 which consists of a groove running concentrically to the center axis of the container closure. The attenuated area is so constructed that the actuating arm 5 can be swiveled upwardly in the direction of the bottom 15. The fulcrum of such a swiveling movement is located in the region of the point of intersection of the contact surface 7 and the sealing surface 13. Due to the fact that the actuating arm is swiveled in a counterclockwise direction, the sealing lip 3 is also swiveled counterclockwise.

When the closure 1 is placed on a container, the region of the mouth of the container, or its top outer surface, is in contact, on the one hand, with the contact surface 7 of the sealing lip 3, and on the other hand, with the sealing surface 13 of the actuating arm 5.

Figure 2:
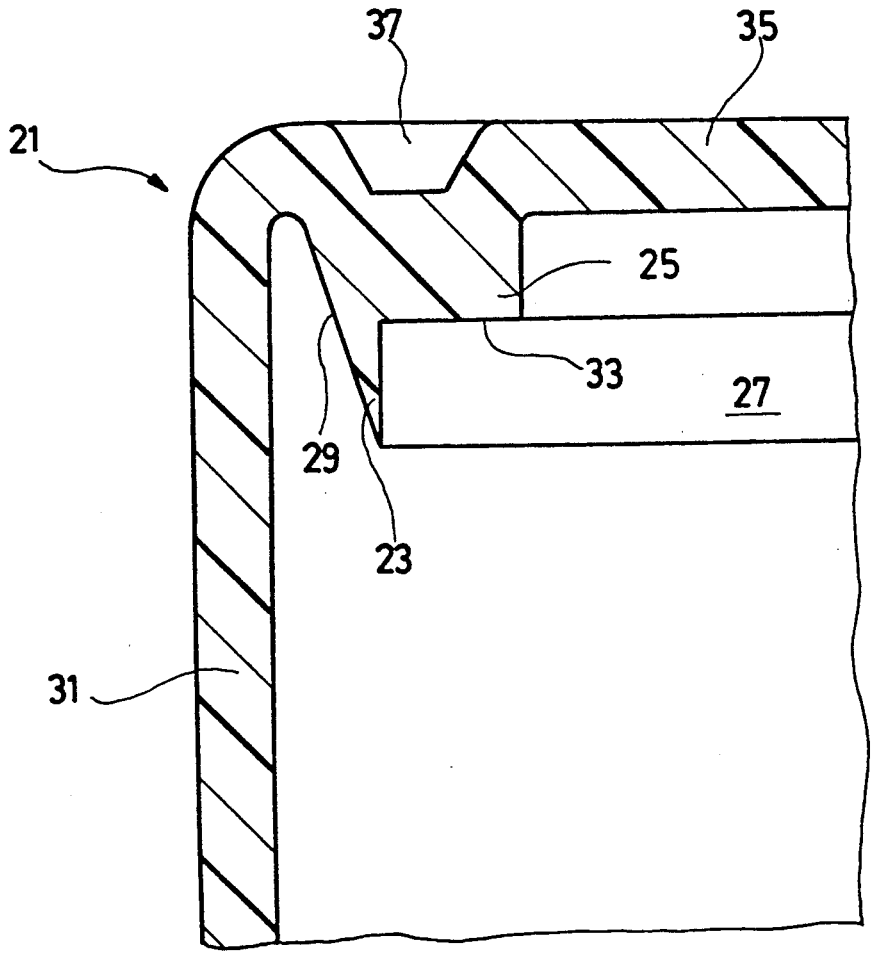
FIG. 2 is a cross section of an additional exemplary embodiment of a seal.

FIG. 2 represents an additional exemplary embodiment of a seal consisting of a sealing lip and an actuating arm, which also is part of a plastic closure for containers. FIG. 2 again reproduces only a partial cross section of a container closure.

The container closure 20 again has a seal which possesses a sealing lip 23 and an actuating arm. The sealing lip 23 has an essentially triangular cross section, resulting in the formation of a contact surface 27 disposed concentrically to the center axis of the closure 20. This contact surface can form an angle of approximately 10° to 85° with an outer boundary surface 29 of the sealing lip 23. The angle is preferably within the range of 15° to 40°. In the exemplary embodiment illustrated, the contact surface 27 and the outer boundary surface 29 form an angle of about 20°.

The outer boundary surface 29 of the sealing lip 23 merges with the side wall 31 of the container closure 21.

Here again, the actuating arm 25 possesses a sealing surface 33 oriented in the direction of the container to be closed and forming an angle of about 90° with the contact surface 27.

The side wall 31 of the closure 21 merges with a bottom 35. In this exemplary embodiment, as in that shown in FIG. 1, the actuating arm 25 is part of the bottom 35. An attenuated area 37 is provided in the wall of the container closure in the region of the actuating arm, and here again, this area 37 is constructed as a groove arranged concentrically to the center axis of the closure 21. Any given cross section can be selected for the groove. While in the exemplary embodiment according to FIG. 1 a groove with a roughly semicircular cross section was selected, here the groove has a trapezoidal cross section.

When the container closure 21 is placed on a container, the top edge of the container presses against the sealing surface 33. Because of the attenuated area 37, the actuating arm 25 is able to give way under this type of force, resulting in a swiveling movement. The fulcrum of this swiveling movement here is located roughly in the region of the point of intersection between the contact surface 27 and the sealing surface 33. When the closure is placed on a container, the actuating arm is swiveled counterclockwise. Due to the mechanical connection between the sealing lip 23 and the actuating arm 25, this causes a counterclockwise swiveling movement of the sealing lip 23. The swiveling movement of the sealing lip 23 is also indirectly facilitated by the attenuated area 37.

Figure 3:
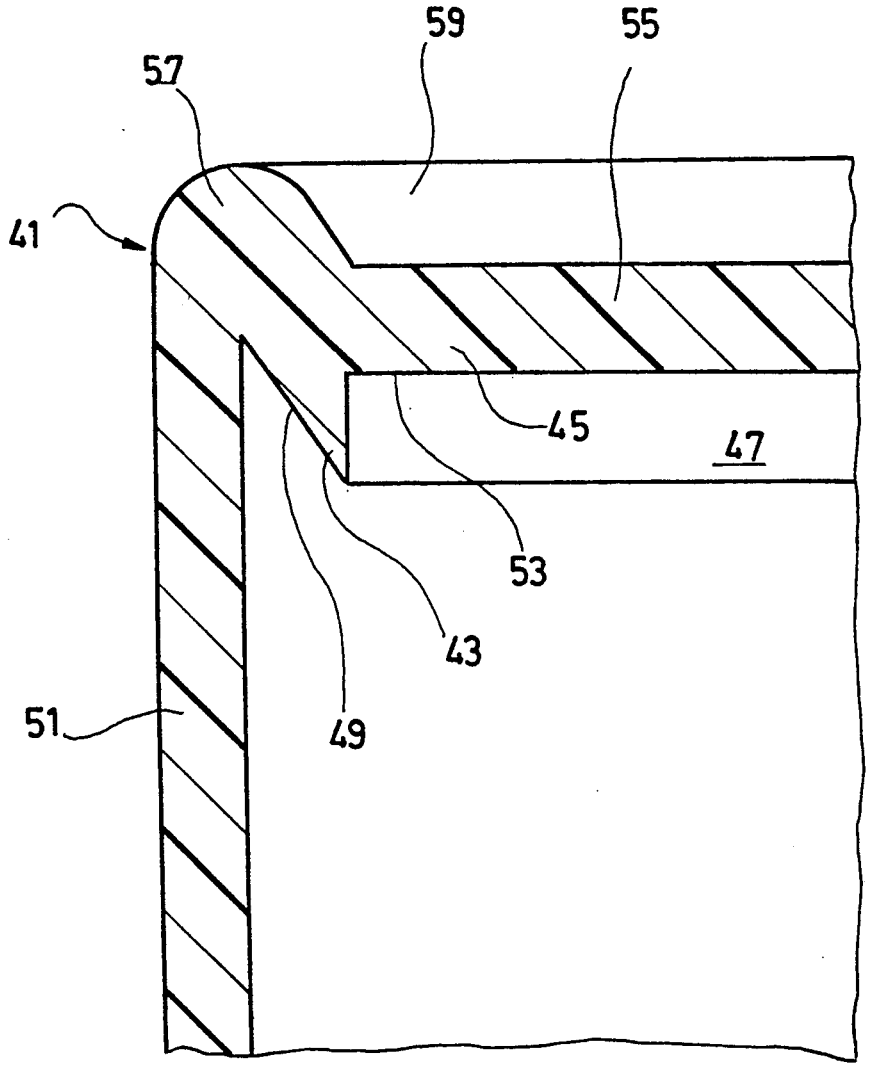
FIG. 3 is a cross section of an additional exemplary embodiment of a seal.

FIG. 3 shows a partial cross section through a plastic container closure 41 with a seal consisting of a sealing lip 43 and an actuating arm 45.

The sealing lip has a triangular cross section. It has a contact surface 47 running parallel to the center axis of the container closure, plus an outer boundary surface 49. The contact surface and the boundary surface can form an angle of 10° to 85°. In the exemplary embodiment shown, an angle of about 20° has been selected. The outer boundary surface 49 merges with the side wall 51 of the closure 41.

The actuating arm 45 has a sealing surface 53 oriented downwardly in the direction of the container to be closed.

The exemplary embodiment illustrated in FIG. 3 is characterized by the fact that the actuating arm 45 is completely integrated into the bottom 55 of the container closure 41. That is, the bottom 55 of the container closure is a continuation of the actuating arm 45.

The sealing surface 53 of the actuating arm 45 and the contact surface 47 of the sealing lip 43 form an angle of about 90°. The angle can also be smaller than 90°.

The side wall 51 of the container closure 41 merges with the bottom 55 via a bump or bead 57. In this way the bottom 55 is disposed in a sunken position with respect to the highest point on the bead 57. A central cavity 59 is thereby formed in the upper sealing region of the closure 41.

The actuating arm 45 is so rigidly connected to the sealing lip 43 that when the actuating arm swivels the sealing lip 43 is moved along with it. When, for example, the actuating arm is swiveled counterclockwise by the force of application against the upper rim of the container, then the sealing lip 43 also shifts counterclockwise.

Figure 4:
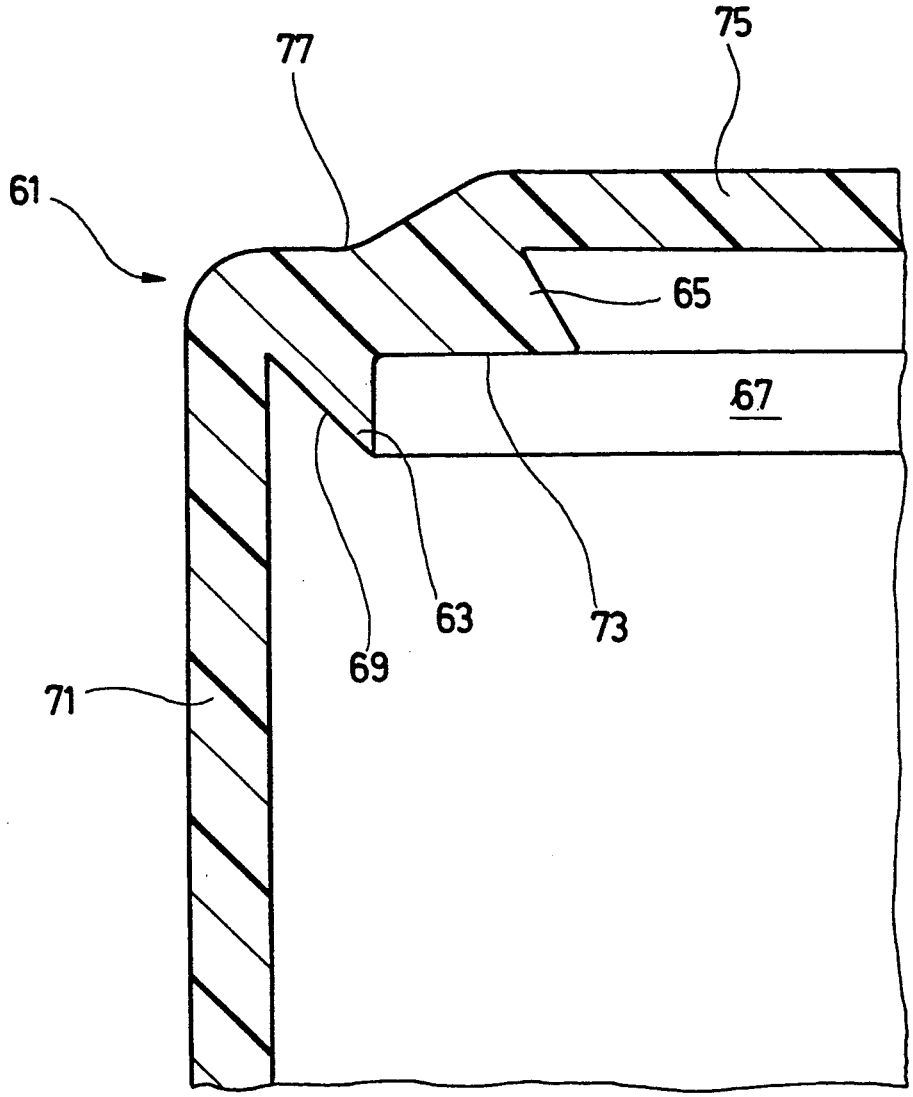
FIG. 4 is a cross section of an additional exemplary embodiment of a seal.

FIG. 4 shows a partial cross section through an additional exemplary embodiment of a seal which is part of a container closure 61. The seal has a sealing lip 63 and an associated actuating arm 65. The sealing lip is triangular in cross section, resulting in the formation of an outer boundary surface 69 and a contact surface 67 which is arranged concentrically to the center axis of the container closure 61. The two surfaces can form an angle of 10° to 85°. In the embodiment represented here, an angle of about 45° has been selected.

The outer boundary surface 69 merges with a side wall 71 of the container closure 61. This is also arranged concentrically to the center axis of the container closure. The actuating arm 65 has a bottom sealing surface 73 oriented in the direction of the container to be closed and forming an angle of about 90° with the contact surface 67 of the sealing lip 63. A larger or smaller angle can also be selected.

The side wall 71 of the container closure 61 merges with a bottom 75. The actuating arm 65 arises from the inner surface of the bottom.

Provided in the region of the actuating arm 65 is a peripheral notch 77, disposed in the area of transition between the side wall 71 and the bottom 75. This notch facilitates a swiveling movement of the actuating arm 65, which occurs when, for example, a force is exerted on the sealing surface 73 by means of the container to be closed. The actuating arm 65 and the sealing lip 63 are rigidly interconnected in such a way that a swiveling movement of the actuating arm imparts a swiveling movement of the sealing lip, the fulcrum of both swiveling movements lying roughly in the region of intersection of the contact surface 67 and the sealing surface 73.

The attenuated area constructed as a notch 77 can be disposed in the region of the bottom, the side wall, or the area of transition between the side wall and the bottom. This is also true of the attenuated areas of the exemplary embodiments illustrated in FIGS. 1 and 2.

Figure 5:
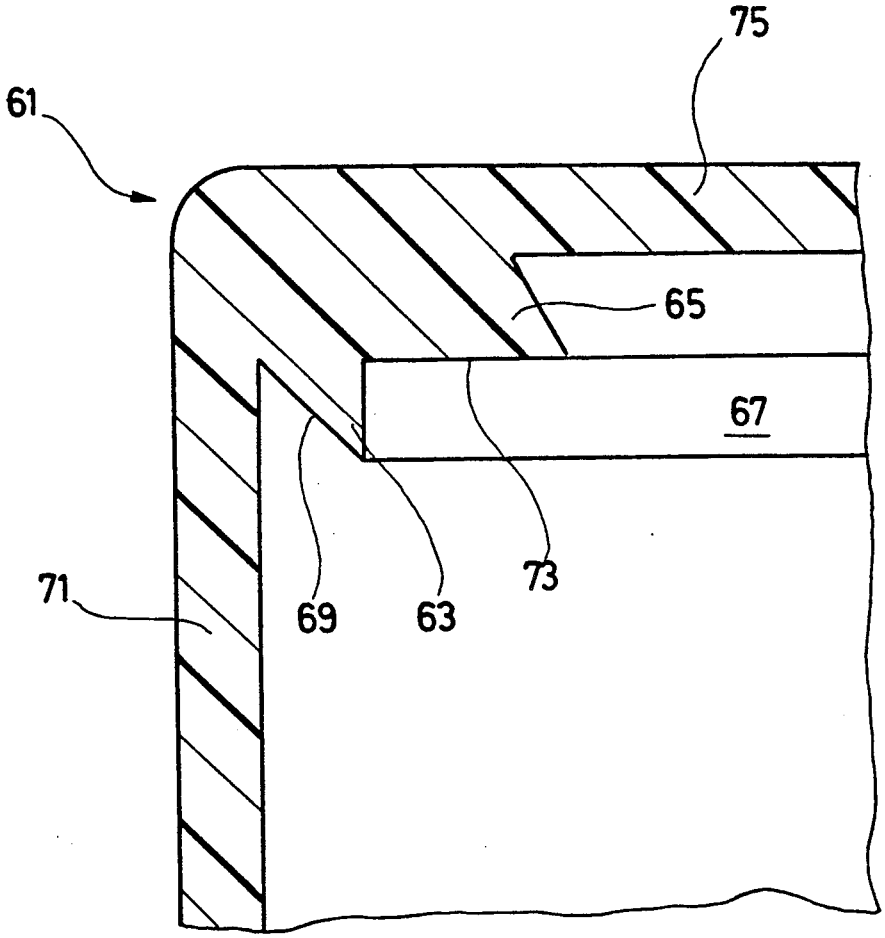
FIG. 5 is a cross section of an additional exemplary embodiment of a seal.

FIG. 5 shows a cross section through a seal which is part of a container closure 61'. Equivalent parts have been given the same reference numbers to eliminate the need to describe them in detail.

As in the exemplary embodiment of FIG. 4, the seal possesses a sealing lip 63 and an actuating arm 65.

The sealing lip 63 is again triangular in cross section, resulting in the formation of a contact surface 67 arranged concentrically to the center axis of the closure and an outer boundary surface 69 of the sealing lip 63. The outer boundary surface merges with the side wall 71 of the closure.

The actuating arm is provided with a sealing surface 73 which points toward the container to be closed. The side wall 71 of the container closure 61 is continued by a bottom 75.

In contrast to the exemplary embodiment represented in FIG. 4, there is no peripheral notch 77 in this case.

The choice of plastic as the material for the container closure 61' nevertheless ensures that when a force is exerted on the sealing surface 73 of the actuating arm 65, a swiveling movement of both the actuating arm and the sealing lip 63 is possible. This is accompanied by elastic deformation of the bottom 75 with respect to the actuating arm 65 and of the sealing lip 63 with respect to the side wall 71.

The function of the seal can readily be deduced from the above description. When a force is exerted from below on the sealing surface of the actuating arm, the actuating arm is swiveled counterclockwise. Due to the relatively rigid connection with the sealing lip, the latter also is so swiveled that it is pressed against the outer boundary surface of the container to be closed. Thus, when the seal consisting of the sealing lip and the actuating arm is pressed onto a container, the sealing surface of the actuating arm acts as a leakproofing surface, but so does the sealing lip, which is pressed against the external outer wall of the container running concentrically to the center axis of the closure. The fact that the sealing lip is pressed against the outer wall of the container results in optimal sealing of the container, even when there is damage in the region of the mouth of the container, i.e., in the region between the horizontal and vertical boundary surface of the container.

Various overpressures in the container can be securely sealed by means of the described seal. The overpressure to be sealed can be varied, depending on the length selected for the sealing lip. The longer the sealing lip, the broader the area spanned on the outside of the container, and thus the higher the allowable overpressure in the container.

It becomes apparent that the actuating arm of the seal is not swiveled solely by the force exerted on the sealing surface during the closing of the container. Due to the connection with the bottom of the container closure, it is also possible for the actuating arm to be swiveled by an overpressure in the container. If the bottom of the closure bulges upward due to an overpressure, this bulge causes the actuating arm to swivel counterclockwise. It also causes the sealing lip to swivel counterclockwise and to be pressed against the outside of the container to be closed. An overpressure in the container thus enhances the sealing effect of the seal.

It should be particularly emphasized that if there is excessive pressure in the container the seal can be lifted away from the region of the mouth of the container to allow the overpressure to escape. As the overpressure drops, the seal again is applied against the container and seals it in an optimal manner.

The release of overpressures can be introduced deliberately by configuring the seal in a given manner. The shorter the sealing lip, the smaller the area it spans on the outer wall of the container, and the lower the overpressure at which this excess pressure will be released.

Figure 6:
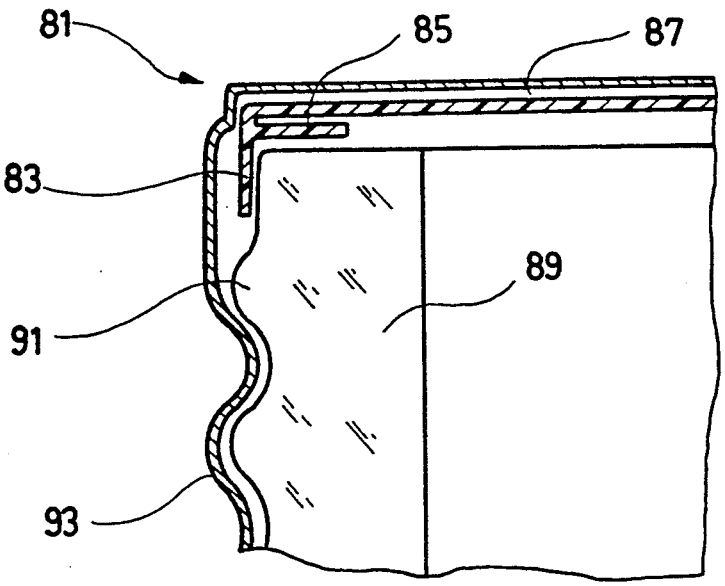
FIG. 6 is a cross section of an additional exemplary embodiment of a seal which is part of a gasket.

The partial cross section illustrated in FIG. 6 shows that the seal consisting of a sealing lip and an actuating arm can also be part of a gasket, which in this case, by way of example, is inserted in a metal closure.

The container closure 81 consists of a deep-drawable material, for example steel or aluminum. It is provided with a first sealing lip 83 and a second sealing lip 85 which serves as the actuating arm. The seal is made of an elastic material, plastic, for example, and is shaped to conform to a gasket 87 built into the container closure. The area of transition between the seal and the gasket is so elastic that a swiveling movement of the second sealing lip 85 leads to a swiveling movement of the first sealing lip 83. Thus, when the container 89 to be closed presses against the second sealing lip 85 from below, the latter swivels counterclockwise. Due to the relatively rigid connection between the first and the second sealing lips, this elicits a swiveling movement of the first sealing lip 83, also in a counterclockwise direction. As a result of this swiveling movement, the first sealing lip is applied against the outer surface of the container 89 running concentrically to the center axis of the closure, thereby creating a first sealing region between the container 89 and the second sealing lip 85 and a second sealing region between the first sealing lip 83 and the container 89 to be closed.

Indicated on the outside of the container 89 is a thread 91 onto which the side wall 93 of the closure 81 is wound. However, the seal is suitable for use not only as a screw closure, but also as a twist-off or bayonet closure.

It can be seen from the above description that the gasket 87 can readily be combined with a plastic closure.

From the illustration of FIG. 6 it can be seen that the seal can also be constructed as a separate ring with two sealing lips, one sealing lip serving as the actuating arm lying on top of the container and the other sealing lip being applied against the outside of the container.

Figure 7:
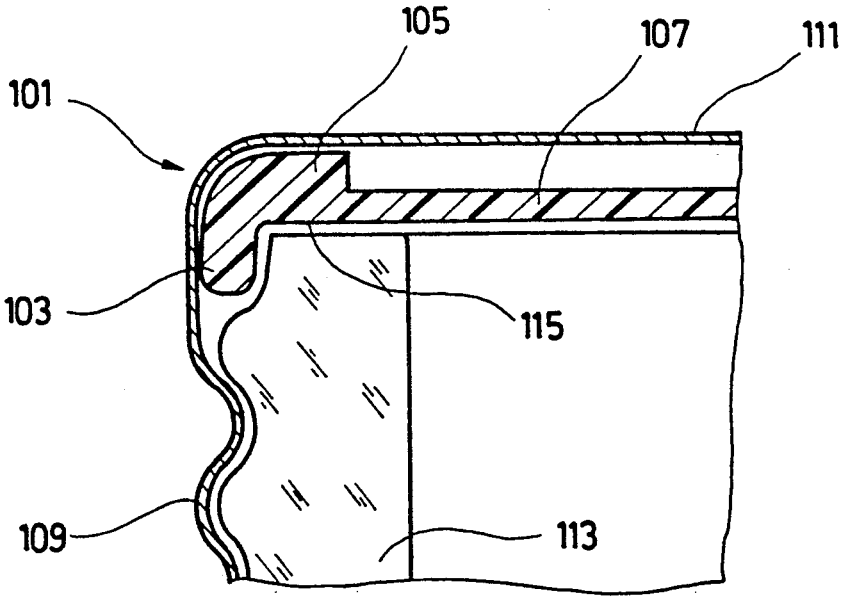
FIG. 7 is a cross section of an additional exemplary embodiment of a seal which is also constructed as part of a gasket.

FIG. 7 shows an additional exemplary embodiment of a container closure 101. This illustration shows a closure made of a deep-drawable material, for example aluminum or steel. The closure is combined with a seal consisting of a sealing lip 103 and an actuating arm 105. The seal is part of a gasket 107 inserted in the container closure 101. A curvature is provided in the region of the transition between the side wall 109 and the bottom 111 of the cap of the container 101. The outer side of the seal, facing the closure, also has a curvature, thus permitting a twisting-off movement of the seal on the inner surface of the closure. The actuating arm 105 of the seal is continued by the gasket 107, the gasket being thinner than the actuating arm in this exemplary embodiment. By this means, a swiveling movement of the actuating arm in the act of closing a container 113 is facilitated by the closure 101. When the container 113 presses against the underside 115 of the actuating arm 105, the latter is swiveled counterclockwise. This causes elastic deformation in the area of transition between the actuating arm and the gasket 107. Due to the relatively rigid connection between the actuating arm and the sealing lip 103, the latter is also swiveled counterclockwise when the actuating arm swivels. As a result, the sealing lip is pressed against the outside of the container 113. Thus, a sealing surface is formed not only between the underside 115 of the actuating arm 105 and the container 113, but also between the outside of the container 113 and the inner surface of the sealing lip 103.

It is also possible to have the connection between the gasket 107 and the actuating arm 105 be so rigid that any bulging of the gasket due to an internal pressure within the container 113 will cause a counterclockwise swiveling movement of the actuating arm 105.

The seal represented in FIG. 7 can also be combined with a plastic closure.

The closure can be constructed as a screw-on, twist-off or bayonet closure. The function of the seal consisting of the sealing lip and actuating arm is not altered thereby.

I claim:

1. A closure for a container, said closure comprising:

a base and a side wall together forming an enclosure;

a pivotal seating device integrally formed with and flexible relative to the side wall and including an axial seal portion adapted to interact with an end face of the container and a radial seal portion adapted to be sealingly engageable with a side wall of the container, the axial seal portion having a horizontally oriented flat annular sealing surface with a radially inner end and a radially outer end, the radial seal portion having a vertically oriented flat annular sealing surface with an axially upper end and an axially lower end, the axially upper end of the sealing surface of the radial seal portion converging with the radially outer end of the sealing surface of the axial seal portion to form a right-angled rocker lever which is adapted to pivot in response to an axial force imparted on the axial seal portion of the rocker lever by the container;

the axial seal portion being integrally connected with the radial seal portion as a single piece, for pivoting the radial seal portion inwardly into a tightly sealed position against the side wall of the container in response to pivotal movement of the axial seal portion resulting from an axial inward force imparted by the end face of the container on the axial seal portion; and recess means formed in the base for weakening an area of the base behind the axial seal portion, thereby encouraging pivot movement of the axial and radial seal portions together in response to axial inward force delivered to the axial seal portion.

2. A closure for a container, said closure comprising:

a base and a side wall together forming an enclosure;

a sealing device having an axial seal adapted to interact with an end face of the container and a sealing lip adapted to interact axially with an outer, side surface of the container;

an actuating arm attached to said sealing lip;

said actuating arm and said sealing lip being rigidly connected as a single piece to form a rigid rocker whereby upon swiveling movement of the actuator arm the sealing lip also swivels in the same direction as the actuator arm; and wherein a weakening zone is provided in the base of the closure in the area of the sealing device to facilitate swiveling movement, whereby the actuating arm forms the axial seal and coincides with the base.

3. A closure for a container according to claim 2, wherein the sealing lip further includes a contact surface which is essentially parallel to the outer, side surface of the container.

4. A closure for a container according to claim 3, wherein said axial seal includes a sealing surface which forms a right angle with said contact surface.

5. A closure for a container according to claim 2, wherein said weakening zone is formed as a groove concentric to the center axis of the container closure.

6. A closure for a container according to claim 5, wherein said groove has a semi-circular cross-sectional shape.

7. A closure for a container according to claim 5, wherein said groove has a trapezoidal cross-sectional shape.

8. A closure for a container according to claim 2, wherein said sealing device is part of a sealing washer of the closure.

* * * * *

UNITED STATES PATENT AND TRADEMARK OFFICE

CERTIFICATE OF CORRECTION

PATENT NO. : 5,129,533

DATED : July 14, 1992

INVENTOR(S) : MANFRED LOFFLER

It is certified that error appears in the above-identified patent and that said Letters Patent is hereby corrected as shown below:

Column 1, after line 10, delete the heading

"SUMMARY OF THE INVENTION--;

after line 21, insert the heading

--SUMMARY OF THE INVENTION--.

Column 2, line 21, "here in" should be --herein--;

line 26, delete "forms".

Signed and Sealed this

Thirty-first Day of August, 1993

Bruce Lehman

*Attest:*

BRUCE LEHMAN

*Attesting Officer*

*Commissioner of Patents and Trademarks*